US011920573B2

(12) United States Patent
Hansen et al.

(10) Patent No.: US 11,920,573 B2
(45) Date of Patent: Mar. 5, 2024

(54) PRESSURE EXCHANGER

(71) Applicant: Danfoss A/S, Nordborg (DK)

(72) Inventors: Poul Erik Hansen, Aabenraa (DK); Tommi Kolb, Nordborg (DK)

(73) Assignee: Danfoss A/S, Nordborg (DK)

( * ) Notice: Subject to any disclaimer, the term of this patent is extended or adjusted under 35 U.S.C. 154(b) by 103 days.

(21) Appl. No.: 17/582,149

(22) Filed: Jan. 24, 2022

(65) Prior Publication Data

US 2022/0235749 A1 Jul. 28, 2022

(30) Foreign Application Priority Data

Jan. 28, 2021 (EP) ..... 21153911

(51) Int. Cl.
*F04B 1/2064* (2020.01)
*F04B 1/2035* (2020.01)
*F04F 13/00* (2009.01)

(52) U.S. Cl.
CPC ..... *F04B 1/2064* (2013.01); *F04B 1/2035* (2013.01); *F04F 13/00* (2013.01)

(58) Field of Classification Search
CPC ..... F04B 1/20; F04B 1/2007; F04B 1/2014; F04B 1/2035; F04B 1/2064; F03C 1/0647
USPC ..... 416/64
See application file for complete search history.

(56) References Cited

U.S. PATENT DOCUMENTS 2,766,928 A * 10/1956 Boszormenyi ..... F04F 13/00 418/141
3,935,796 A * 2/1976 Wood ..... F04B 1/2064 91/504
4,174,925 A * 11/1979 Pfenning ..... B01D 61/06 417/225
4,508,263 A * 4/1985 Pedersen ..... G05D 23/023 403/362
5,143,286 A * 9/1992 Hansen ..... G05D 23/023 285/314
9,328,743 B2 5/2016 Hirosawa et al.
(Continued)

FOREIGN PATENT DOCUMENTS

CN 101506533 A 8/2009
CN 104373313 A 2/2015
(Continued)

OTHER PUBLICATIONS

First Examination Report for Indian Patent Application No. 202214000196 dated Aug. 5, 2022.

*Primary Examiner* — Woody A Lee, Jr.
*Assistant Examiner* — Justin A Pruitt
(74) *Attorney, Agent, or Firm* — McCormick, Paulding & Huber PLLC

(57) ABSTRACT

A pressure exchanger (1) including a housing (2), a drive shaft (3) and a cylinder drum (4) rotatably arranged in the housing (2) is described, the cylinder drum (4) including two front faces and at least one cylinder (5) between the front faces, wherein the housing (2) includes a port flange (7, 8) at each end of the cylinder drum (4) and at least at one end of the cylinder drum (4) a pressure shoe (18) is arranged between the cylinder drum (4) and the port flange of this end. Such a pressure exchanger should be operated in a cost-effective manner. To this end an adjustable stop arrangement (19) is arranged between the pressure shoe (18) and the cylinder drum (4).

14 Claims, 2 Drawing Sheets

(56) References Cited

U.S. PATENT DOCUMENTS

| | | | | |
|---|---|---|---|---|
| 9,546,671 | B2 | 1/2017 | Hirosawa et al. | |
| 9,556,736 | B2 * | 1/2017 | Sigurdsson | F04B 9/117 |
| 9,822,876 | B2 * | 11/2017 | Tsuji | B60T 1/062 |
| 2014/0048143 | A1 * | 2/2014 | Lehner | B01D 61/10 137/625.21 |
| 2015/0050164 | A1 | 2/2015 | Sigurdsson | |
| 2015/0152854 | A1 * | 6/2015 | Terauchi | F04B 27/0895 417/270 |

FOREIGN PATENT DOCUMENTS

| | | | |
|---|---|---|---|
| CN | 105605024 | A | 5/2016 |
| CN | 107218265 | A | 9/2017 |
| EP | 2 837 824 | A1 | 2/2015 |
| EP | 2 837 825 | A1 | 2/2015 |
| EP | 3 020 968 | A1 | 5/2016 |

* cited by examiner

PRESSURE EXCHANGER

CROSS-REFERENCE TO RELATED APPLICATION

This application claims foreign priority benefits under 35 U.S.C. § 119 to European Patent Application No. 21153911.9 filed on Jan. 28, 2021, the content of which is hereby incorporated by reference in its entirety.

TECHNICAL FIELD

The present invention relates to a pressure exchanger comprising a housing, a drive shaft, and a cylinder drum rotatably arranged in the housing, the cylinder drum comprising two front faces and at least one cylinder between the front faces, wherein the housing comprises a port flange at each end of the cylinder drum and at least at one end of the cylinder drum a pressure shoe is arranged between the cylinder drum and the port flange of this end.

BACKGROUND

A pressure exchanger is used to transfer a pressure of one fluid to another fluid. To this end the cylinder drum is rotated by means of a motor. A first fluid having a high pressure is supplied to one side of the cylinder drum and enters a cylinder of the cylinder drum via the port flange. This first fluid transfers its pressure to a second fluid in the cylinder. The second fluid of the cylinder is outputted of the cylinder via the other port flange. The other port flange has an input to which the second fluid with low pressure is supplied. The first port flange has a return connection through which the first fluid is outputted after it has transferred the pressure to the second fluid.

In order to keep internal losses of the fluids low, the cylinder drum must be moved over the respective port flanges in a sliding contact. This sliding contact must however not produce too much friction in order to avoid wear. During operation, i.e. once the pressure exchange has started, the pressures on the pressure shoe and the forces resulting from these pressures are balanced, so that the pressure shoe is held with a sufficient force against the port flange, however, this force is dimensioned so low that friction is acceptable.

The situation is somewhat different when the pressure exchanger starts operation. In this situation there is not enough pressure of the fluid present inside the housing, so that the pressure shoe is not held sufficiently tight against the port flange. In this case the leakages would be so high that a reliable start of the operation of the pressure exchanger might fail.

In order to overcome this problem, it has been proposed to use springs between the cylinder drum and the pressure shoe to press the pressure shoe with sufficient forces against the port flange. However, during starting of the pressure exchanger these springs produce a large friction force, so that a motor having a large torque and consequently a large power is required. In some cases, the torque required for starting rotation of the cylinder drum is five to ten times the torque required during normal operation.

The use of a large motor produces costs. Furthermore, when an over dimensioned motor is used, the motor is usually not operated at the optimum operation point. This produces additionally energy costs.

SUMMARY

The object underlying the invention is to provide a pressure exchanger that can be operated in a cost-effective manner.

This object is solved with a pressure exchanger as described at the outset in that an adjustable stop arrangement is arranged between the pressure shoe and the cylinder drum.

The adjustable stop limits the movement of the pressure shoe between the port flange and the cylinder drum. When this movement is limited, the size of a gap between the pressure shoe and the port flange can be limited as well. Thus, the stop arrangement can be adjusted in a way that the gap between the pressure shoe and the port flange does not exceed a size in which the leakages are no longer acceptable. With an acceptable leakage, however, the pressure exchanger can be started. During the following "normal" operation, the pressure shoe is loaded by pressures of the fluid and forces produced by these pressures are balanced in a way that the pressure shoe is held in a position in which the leakages are at a minimum and at the same time the friction forces between the pressure shoe and the port flange are also at a minimum.

In an embodiment of the invention the stop arrangement rotates together with the pressure shoe and the cylinder drum. Thus, there are no friction forces between the pressure shoe and the stop arrangement.

In an embodiment of the invention the stop arrangement is adjustable from the outside of the housing. This means that the position of the stop arrangement can be adjusted when the cylinder drum is already built in the housing. Since the stop arrangement is adjustable from the outside, tolerances in the elements forming the pressure exchanger can be tolerated to a large extent.

In an embodiment of the invention the stop arrangement comprises a holder which at least during operation of the pressure exchanger is held in a predefined axial position, wherein the holder comprises at least one stop element. The axial position relates to the axis of rotation of the cylinder drum. When the holder is held in the predefined axial position, the stop element is also held in a predefined axial position and can in this way define a limit action for a movement of the pressure shoe in a direction towards the cylinder drum.

In an embodiment of the invention at least during operation of the pressure exchanger the holder rests against the cylinder drum. In other words, the cylinder drum forms a stop against a movement of the holder and defines the axial position of the holder. No further stop is necessary.

In an embodiment of the invention during adjustment the stop element is moved axially with respect to the holder. In other words, it can be shifted in axial direction to vary the stop position of the pressure shoe.

In an embodiment of the invention the stop element is in form of a pin having a constant cross section over an adjustment length. This is a simple form of a stop element.

In an embodiment of the invention the stop element is held with press fit in the holder. The press fit is dimensioned so that the stop element can be moved in relation to the holder during the adjustment of the stop arrangement. However, the press fit holds the stop element tightly enough so that it cannot be moved by forces produced by the pressures during start and normal operation of the pressure exchanger.

In an embodiment of the invention the holder is in form of a plate arranged on the drive shaft and moveable at least in axial direction together with the drive shaft. When the drive shaft is axially moved, the plate is moved together with the drive shaft. Thus, for the adjustment of the adjustable stop it is sufficient to move axially the drive shaft.

In an embodiment of the invention one end of the pressure exchanger is provided with an inner thread, wherein the inner thread comprises an axis parallel to an axis of rotation of the drive shaft, wherein an adjustment bolt can be threaded into the inner thread to contact the drive shaft or the cylinder drum. In a preferred embodiment the axis of the inner thread coincides with the axis of rotation. When the bolt is threaded into the inner thread and contacts the drive shaft or the cylinder drum, rotation of the bolt will cause an axial movement of the cylinder drum or of the shaft. When the holder is axially moved together with the cylinder drum or with the drive shaft, the movement of the holder will press the stop element against the pressure shoe. Upon further movement the stop element will further be moved into the holder. When the pitch of the thread is known there is a unique relation between the angle of rotation of the bolt and the axial movement produced by this rotation. Thus, the position of the stop arrangement can precisely be adjusted.

In an embodiment of the invention the drive shaft comprises a driven end and the thread is arranged opposite the driven end. At the driven end there is usually a coupling to couple the drive shaft with a motor. The other end is free, so that the inner thread can be arranged at the other end.

In an embodiment of the invention the inner thread is arranged at the end remote from the adjustable stop. During adjustment the cylinder drum is pushed into the housing. In most cases it is easier to produce pushing forces than pulling forces.

In an embodiment of the invention the cylinder drum comprises at least one blind hole in a front face and the at least stop element protrudes into the blind hole. In this way it is possible to use a conventional cylinder drum which has previously been used together with the springs as described above. Furthermore, the blind hole provides sufficient space for the stop element in a simple way.

In an embodiment of the invention the stop element protrudes out of the holder in a direction towards the pressure shoe. Thus, only the stop element forms the stop for the pressure shoe and not the holder. This simplifies the adjustment.

BRIEF DESCRIPTION OF THE DRAWINGS

A preferred embodiment of the invention will now be described with reference to the drawing, in which.

DETAILED DESCRIPTION

Figure 1:
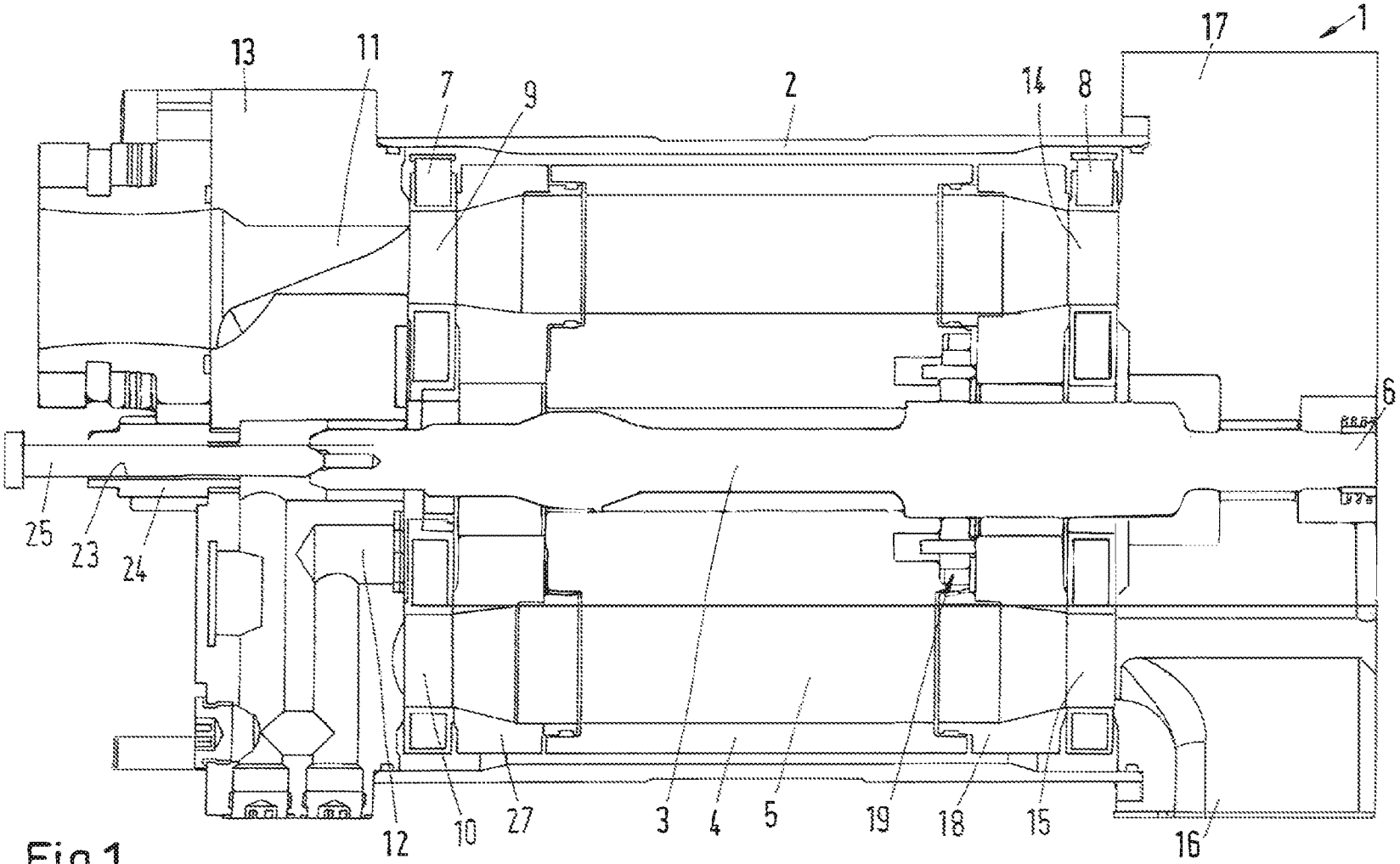
FIG. 1 shows a schematic section in a view of a pressure exchanger.

In all Figures the same elements are denoted with the same reference numerals.

FIG. 1 schematically shows a pressure exchanger 1 comprising a housing 2, a drive shaft 3 and a cylinder drum 4 which is rotatably arranged in the housing 2. The cylinder drum 4 comprises a plurality of cylinders 5 which are evenly distributed in circumferential direction around the drive shaft 3. However, theoretically one cylinder 5 would be sufficient.

The cylinder drum is rotationally fixed to the drive shaft 3. The drive shaft 3 comprises a driven end 6.

The driven end 6 can be provided with a coupling to connect a drive motor or other driving means to rotate the drive shaft 3.

Port flanges 7, 8 are arranged at each end of the cylinder drum 4. The cylinder drum 4 rotates with respect to the port flanges 7, 8.

First port flange 7 comprises two kidney-shaped openings 9, 10 which are connected to ports 11, 12 in an end part 13 of the housing 2. The second port flange 8 comprises two kidney-shaped openings 14, 15 which are connected to port 16 (the other port is not shown) in a second end part 17 of the housing.

A pressure shoe 18 is arranged between the cylinder drum 4 and the second port flange 8. The pressure shoe 18 is sealed with respect to the cylinders 5 of the cylinder drum 4 (seals are not shown) and is slightly moveable with respect to the cylinder drum 4, so that during operation it can be held in contact with the second port flange 8.

During operation, i.e. when fluids in the pressure exchanger 1 already have an elevated pressure, these pressures produce forces on the pressure shoe 18, which are balanced such that the pressure shoe 18 is held with low friction against the second port flange 8 to secure a tightness in the contact area between the second port flange 8 and the pressure shoe 18, however, with a low friction between the pressure shoe 18 and the second port flange 8. The pressure shoe 18 rotates together with the cylinder drum 4.

However, when the pressure exchanger 1 is started the necessary pressures in the fluids are not available.

In order to achieve nevertheless the necessary tightness within the pressure exchanger 1, a stop arrangement 19 is provided limiting a movement of the pressure shoe 18 away from the second port flange 8. As will be explained later on, the stop arrangement 19 limits a movement of the pressure shoe 18 away from the second port flange 8 so that a gap between the pressure show 18 and the second port flange 8 does not exceed a predefined and allowable size.

Figure 3:
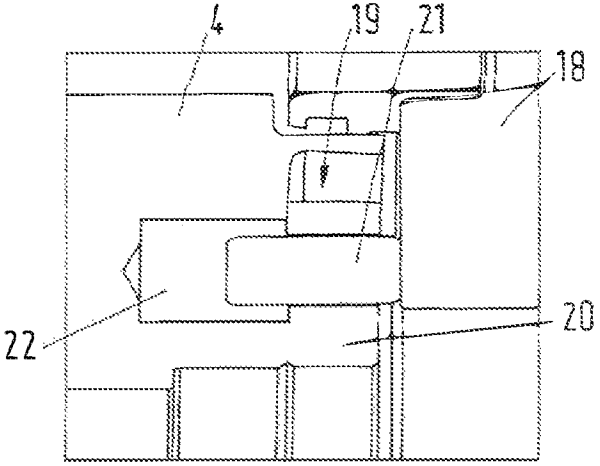
FIG. 3 shows the stop arrangement at the end of the adjustment.
Figure 4:
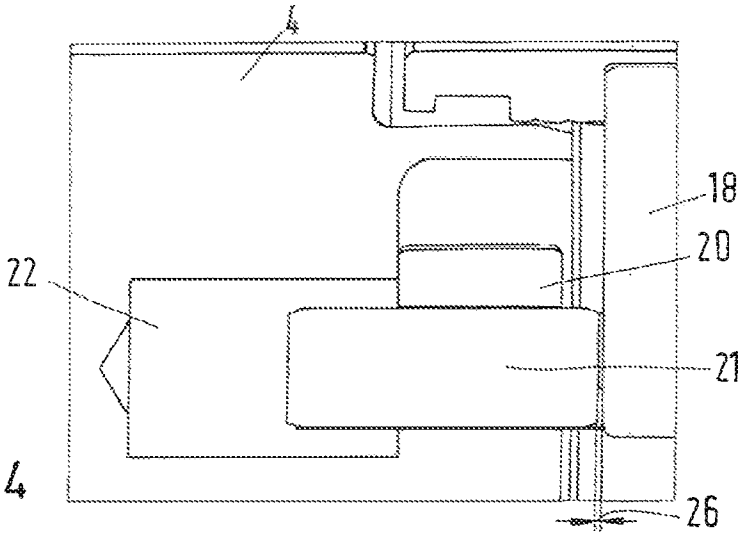
FIG. 4 shows the stop arrangement before the start of the pressure exchanger.

The stop arrangement 19 will be explained in more detail with reference to FIGS. 2 to 4.

The stop arrangement 19 comprises a holder 20 in form of a disk or plate which is mounted on the drive shaft 3 and rests against the cylinder drum 4. The holder 20 holds a number of stop elements 21 (only one shown in FIGS. 2 to 4). The stop elements 21 are distributed in circumferential direction around the drive shaft 3. In a preferred embodiment there are twelve stop elements 21.

Before adjusting the stop arrangement 19, the stop element 21 protrudes out of the holder 20 at least in a direction towards the pressure shoe 18. However, it is preferred that the stop element 21 protrudes out of the holder 20 on both sides.

The cylinder drum 4 comprises a number of blind holes 22. These blind holes 22 accommodate an end of the stop element 21 protruding out of the holder 20 in a direction towards the cylinder drum 4. The blind holes 22 are a result of the fact that the cylinder drum 4 is of the same type as a cylinder drum which has been used together with a spring arrangement.

The stop elements 21 are in form of a pin having a constant cross section (at least over an adjustment length). The stop elements 21 are held in the holder 20 with press fit. When a force is exerted on the stop element 21 which overcomes the force produced by the press fit, the stop element 21 can be moved with respect to the holder 20. This movement is directed parallel to the axis of rotation of the drive shaft 3.

FIG. 1 shows means for producing such forces.

The first end part 13 is provided with an inner thread 23. The inner thread can be provided in a thread element 24 which can be fixed to the first end part 13 and can be removed from the first end part 13 after the adjustment. A bolt 25 can be threaded into the inner thread 23. The bolt 25 is threaded into the inner thread 23 until it contacts the drive shaft 3. Alternatively, it can contact directly the cylinder drum 4.

Thus, when the bolt 25 is rotated, it can move the drive shaft 3 in axial direction towards the second end part 17. When the drive shaft 3 is moved axially, the cylinder drum 4 is also moved axially and the holder 20 which contacts the cylinder drum 4 is also moved axially in a direction towards the second end part 17 and thus towards the pressure shoe 18.

Figure 2:
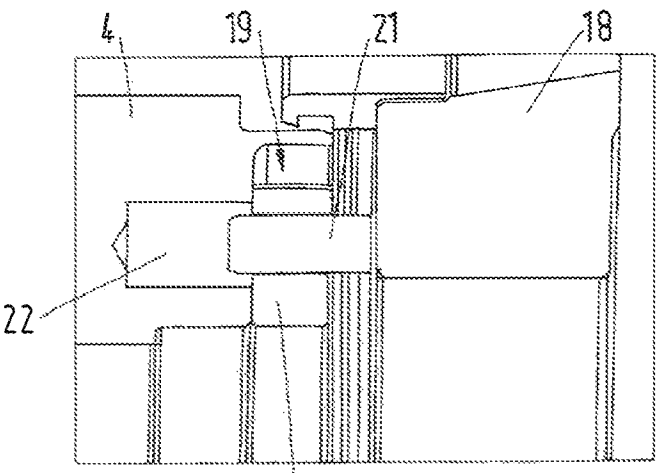
FIG. 2 shows schematically a stop arrangement at the beginning of an adjustment.

Due to this movement of the cylinder drum 4 the stop element 21 comes in contact with the pressure shoe 18 (FIG. 2). Upon further movement of the cylinder drum 4 the stop element 21 is moved in relation to the holder 20, so that the end contacting the pressure shoe 18 will be shorter and the length of the end protruding into the blind hole 22 will be longer.

When the pitch of the thread 23 is known, it is possible to precisely adjust the axial position of the holder 20. When the thread 23, for example, has a pitch of 1.5 mm per revolution, rotating the bolt 25 by 24° will cause a movement of the cylinder drum 4 and consequently of the holder 20 by 0.1 mm.

Thus, it is possible to adjust the holder 20 and together with the holder the stop elements 21 so that (after removing the bolt 25) a gap 26 is formed between the stop elements 21 and the pressure shoe 18. This gap 26 can have, for example, a thickness of 0.1 to 0.8 mm, in particular 0.2, 0.3, or 0.4 mm.

The pressure shoe 18 is allowed to move away from the second port flange 8 by the same distance.

This means that without other forces a gap can form between the pressure shoe 18 and the second port flange 8 in the same magnitude as the gap 26.

Thus, when the pressure exchanger 8 is started, the pressure shoe 18 slides with low friction or almost no friction over the second port flange 8. Although a small volume of hydraulic fluid can escape through the gap between the pressure shoe 18 and the second port flange 8, this leakage is so small that enough pressure can build up so that this pressure can exert the necessary forces onto a pressure shoe 18 to press it with sufficient, but not too high forces against the second port flange 8.

In the above, only one pressure shoe 18 on the valve of the cylinder drum 4 facing the second end part 17 has been described. However, another pressure shoe 27 can be arranged between the other side of the cylinder drum 4 and the first port flange 7. In this case the two pressures shoes 18, 27 have to share the allowable movement which is defined by the gap 26.

Thus, during start too big leakage is avoided and too much friction is also avoided, so that the pressure exchanger 1 can be operated with a drive motor which is sufficient for normal operation but needs not to overcome large torques during start of the pressure exchanger 1.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A pressure exchanger comprising a housing, a drive shaft, and a cylinder drum rotatably arranged in the housing, the cylinder drum comprising two front faces and at least one cylinder between the front faces, wherein the housing comprises a port flange at each end of the cylinder drum and at least at one end of the cylinder drum a pressure shoe is arranged between the cylinder drum and the port flange of this end, wherein an adjustable stop arrangement is arranged between the pressure shoe and the cylinder drum, wherein the adjustable stop arrangement adjustably limits the maximum allowable movement of the pressure shoe between the port flange and the cylinder drum thus adjustably limiting the size of a gap between the pressure shoe and the port flange during start of the pressure exchanger.

2. The pressure exchanger according to claim 1, wherein the stop arrangement rotates together with the pressure shoe and the cylinder drum.

3. The pressure exchanger according to claim 1, wherein the position of the stop arrangement is adjustable from the outside of the housing when the stop arrangement is arranged between the pressure shoe and the cylinder drum.

4. The pressure exchanger according to claim 1, wherein the stop arrangement comprises a holder which at least during operation of the pressure exchanger is held in a predefined axial position, wherein the holder comprises at least one stop element.

5. The pressure exchanger according to claim 4, wherein at least during operation of the pressure exchanger the holder rests against the cylinder drum.

6. The pressure exchanger according to claim 4, wherein during adjustment the stop element is moved axially with respect to the holder.

7. The pressure exchanger according to claim 6, wherein the stop element is in form of a pin having a constant cross section over an adjustment length.

8. The pressure exchanger according to claim 4, wherein the stop element is held with press fit in the holder.

9. The pressure exchanger according to claim 4, wherein the holder is in form of a plate arranged on the drive shaft and movable at least in axial direction together with the drive shaft.

10. The pressure exchanger according to claim 4, wherein an inner thread is provided at one end of the pressure exchanger, wherein the inner thread comprises an axis parallel to an axis of rotation of the drive shaft, wherein an adjustment bolt can be threaded in the inner thread to contact the drive shaft or the cylinder drum.

11. The pressure exchanger according to claim 10, wherein the drive shaft comprises a driven end and the inner thread is arranged opposite the driven end.

12. The pressure exchanger according to claim 10, wherein the inner thread is arranged at the end remote from the adjustable stop arrangement.

13. The pressure exchanger according to claim 4, wherein the cylinder drum comprises at least one blind hole in a front face and the at least one stop element protrudes into the blind hole.

14. The pressure exchanger according to claim 4, wherein the stop element protrudes out of the holder in a direction towards the pressure shoe.

* * * * *